US006003432A

United States Patent [19]

Laulhe

[11] Patent Number: 6,003,432

[45] Date of Patent: Dec. 21, 1999

[54] ACTUATOR INCLUDING A JACK

[75] Inventor: René Laulhe, Villeneuve D'Ornon, France

[73] Assignee: KSB S.A., Gennevilliers Cedex, France

[21] Appl. No.: 09/011,542

[22] PCT Filed: Jul. 17, 1996

[86] PCT No.: PCT/FR96/01120

§ 371 Date: May 18, 1998

§ 102(e) Date: May 18, 1998

[87] PCT Pub. No.: WO97/04237

PCT Pub. Date: Feb. 6, 1997

[30] Foreign Application Priority Data

Jul. 17, 1995 [FR] France ..... 95 08709

[51] Int. Cl.[6] ..... F15B 15/08

[52] U.S. Cl. ..... 92/69 R; 92/130 A; 92/130 D

[58] Field of Search ..... 92/68, 69 A, 72, 92/73, 69 R, 130 A, 130 D, 135, 136, 138

[56] References Cited

U.S. PATENT DOCUMENTS

| | | | |
|---|---|---|---|
| 1,835,919 | 12/1931 | Waseige | 92/68 X |
| 3,336,842 | 8/1967 | Adelt | 92/135 X |
| 4,354,424 | 10/1982 | Nordlund | 92/69 R X |
| 4,564,169 | 1/1986 | Nordlund | 92/138 X |
| 4,651,626 | 3/1987 | Messina | 92/130 D X |
| 4,905,574 | 3/1990 | Trevisan | 92/69 R |
| 4,949,936 | 8/1990 | Messina | 92/138 X |
| 5,003,864 | 4/1991 | Dyer | 92/130 R X |
| 5,653,419 | 8/1997 | Uchisawa et al. | 92/130 D X |

FOREIGN PATENT DOCUMENTS

| | | |
|---|---|---|
| 0 299 406 | 7/1988 | European Pat. Off. . |
| 1 592 924 | 11/1968 | France . |
| 2 367 207 | 10/1977 | France . |
| WO 80/01096 | 11/1979 | WIPO . |

*Primary Examiner*—John E. Ryznic
*Attorney, Agent, or Firm*—Knobbe Martens Olson & Bear, LLP

[57] ABSTRACT

An actuator including a jack having first and second pistons engaging a control rod, particularly for rotating the shaft of a fraction-of-a-turn plumbing device. The actuator can also include energy storage cartridges and/or damping members placed between the pistons. The energy storage cartridges can engage the first piston on one side and the second piston on the opposite side.

10 Claims, 6 Drawing Sheets

FIG.6A
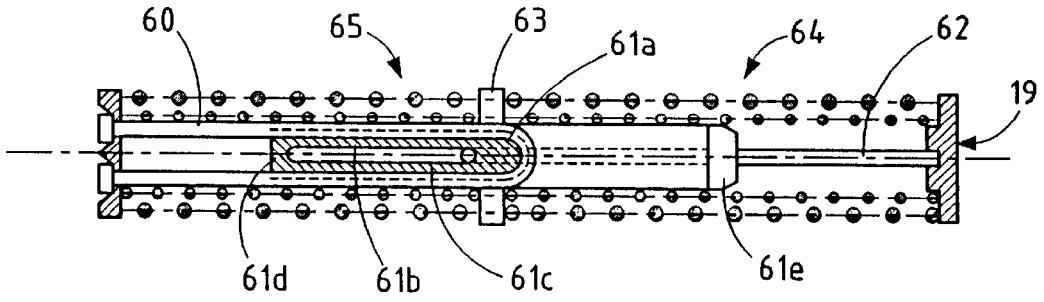
FIG.6B
BB section
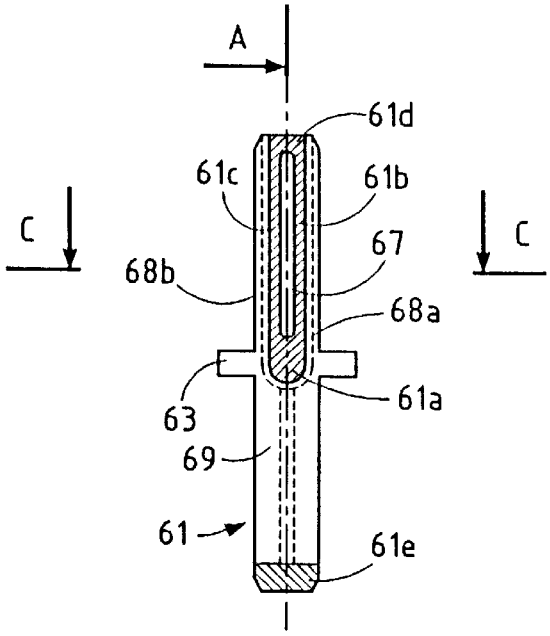
FIG.6C
AA section
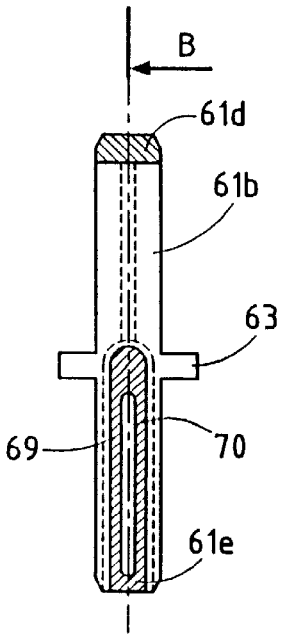
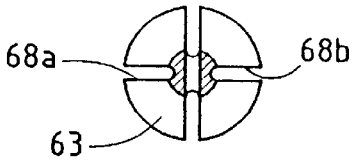
FIG.6D
CC section

ACTUATOR INCLUDING A JACK

TECHNICAL FIELD

The present invention relates to an actuator of the type comprising a jack, having a first and second piston cooperating with a control spindle, for example in order to rotate the shaft of a valve device through a fraction of a turn.

BACKGROUND

Actuators of the type comprising a single-action jack with springs for returning to a preferred position should the supply to the working chamber cease are already known. The energy accumulating in the springs which are compressed under the supply pressure should be sufficient to perform this movement of the pistons and rotate the control spindle.

Usually, the springs bear against the pistons at one end and against the cylinder heads or a fixed part, at the other. If shock absorbers are provided, they are arranged in the same way. In the preferred position, the pistons are located closest to one another. Between the pistons is the working chamber. The supply of pressurised fluid to the working chamber moves the pistons apart counter the force of the springs, thereby compressing them. In the event of an interruption to the main supply causing a drop in pressure in the working chamber, the energy accumulated in the springs pushes the pistons back towards the preferred position.

Owing to the fact that the compression of the springs takes place between the pistons and the cylinder heads of the fixed jack, the entire arrangement is relatively bulky. In order to fix the cylinder heads to the bodies of the jack, very long screws are needed. Moreover, as the springs bear on a fixed component at one end and on a movable component at the other, only some of the energy is recovered.

The aim of the invention is to improve the construction of an actuator of the type comprising a jack.

SUMMARY OF THE INVENTION

The actuator of the type comprising a jack according to the invention is characterised in that energy accumulating cartridges and/or shock-absorbing elements are placed between the pistons, acting at one end against the first piston and at the opposite end against the second piston.

The arrangement of the cartridges and/or shock-absorbing elements in what is normally a dead space makes optimum use of the space available. At the same time, both the active and reactive energy of the cartridges is utilised, as the cartridges bear on two movable components.

The construction of a shock-absorbing system in a double-acting jack with shock-absorbing elements between the pistons has the same advantages of being compact. The construction of a single-action actuator with cartridges and shock-absorbing elements arranged between the pistons combines the advantages of safety and shock absorption in a single system.

The use of the helical springs which cooperate with an element which limits the travel of the springs makes it possible to prefabricate spring cartridges. Thanks to these spring cartridges, the actuator is simple to assemble and a variety of desirable spacing forces is achieved by the use of springs with a suitable recoil constant, while keeping the same dimensions. At the same time, the element inside reduces the buckling of the springs. The element inside comprises two elements functioning as rods which are partially guided in a central structure.

To reduce the buckling still further the central structure is provided with a collar and the spacer springs are divided into two bundles, arranged on either side of the collar.

In a preferred embodiment the element also acts as a shock absorber for combining the functions of safety and shock absorption.

BRIEF DESCRIPTION OF THE FIGURES

The accompanying drawings illustrate the invention:

FIGS. 6*a*–6*d* show a section through a third spacer spring and a spacing-limiting element and different stages of assembly.

DETAILED DESCRIPTION

Figure 1:
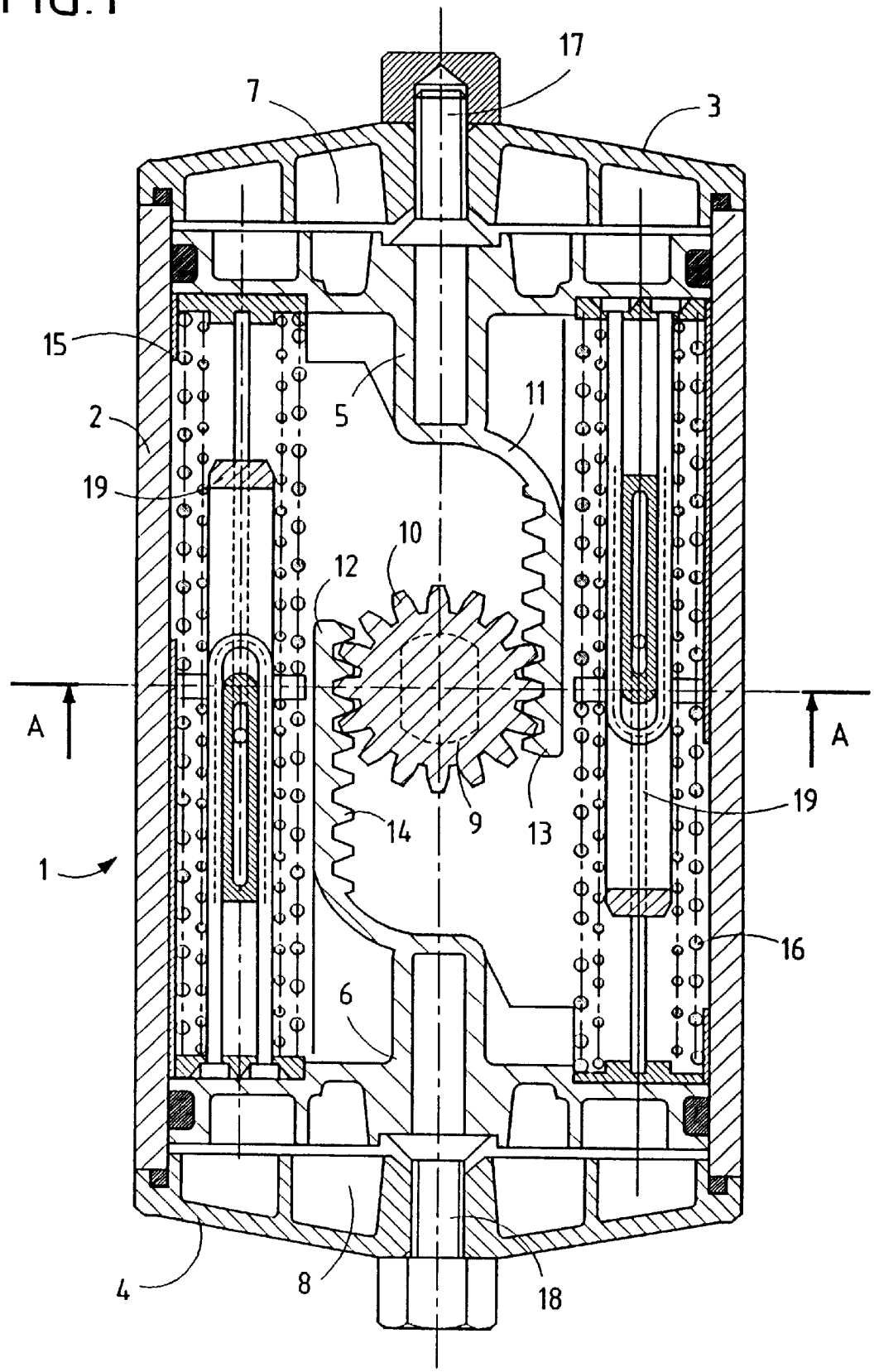
FIG. 1 shows a single-action actuator in axial section on the line BB in FIG. 2.

Referring to FIG. 1 of the drawings, a rotary actuator for a fraction of a turn 1 is shown, of the type comprising a single-action jack body 2 with two cylinder heads 3,4 and two pistons 5,6. Between the cylinder heads 3,4 and the pistons 5,6 are working chambers 7,8 adapted to be connected to a pressure system in order to displace the pistons 5,6 under the effect of a pressurised fluid in the working chambers 7,8. By simultaneously moving the pistons 5,6 a control spindle 9 with teeth 10 is rotationally driven by projecting portions 11, 12 of the pistons 5, 6. The projecting portions 11, 12 also have teeth 13, 14 which mesh with the teeth 10 on the spindle 9.

In order to move the pistons 5,6 away from a position of advance towards the control spindle 9 if the fluid pressure should decrease, spacer springs 15, 16, e.g. energy accumulating cartridges, are placed between the pistons 5, 6. In this embodiment, the spacer springs 15, 16 are arranged on the edge of the pistons 5,6 and partially housed in the projecting portions 11, 12.

In order to regulate the final position of the spaced-apart pistons 5,6, adjustable abutments 17, 18 are provided either in the cylinder heads 3,4 or in the pistons 5,6. The arrangement in the pistons 5,6 has the advantage that the length of the apparatus is reduced if the abutments are supposed to be protected. These abutments 17, 18 are accessible from outside and can be adjusted if necessary.

Along the central spindle of the spacer springs 15, 16 are elements 19 which limit the spacing of the spacer springs 15, 16 outside the actuator before positioning. These elements 19 may also act as shock-absorbers (FIGS. 3*a,* 3*b*).

Figure 2:
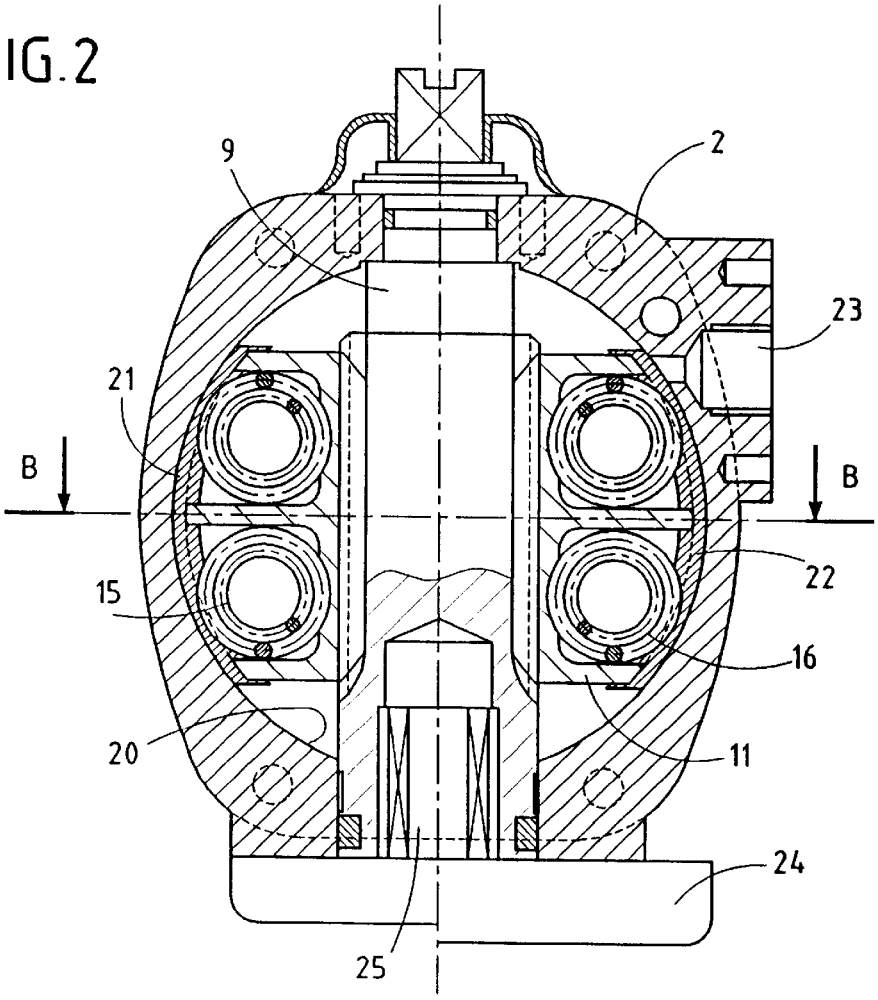
FIG. 2 shows the actuator in section on the line AA in FIG. 1, FIG. 3*a,* 3*b* show a double-action actuator with shock absorbers, in axial section.

Along the section line AA in FIG. 1 is shown, in FIG. 2, the position of the spacer springs 15, 16 in the projecting portions 11, 12. In order to protect the inner surface 20 of the body of the jack 2 from any damage which might be caused by contact with the pistons 5, 6, sliding shoes 21, 22 are placed between the inner surface 20 and the projecting portions 11, 12.

Pressurised fluid connections 23 connect the working chambers to the pressure system. The actuator is mounted on a fraction-of-a-turn valve 24 for rotating an obturator (not shown) through a quarter of a turn by means of the control spindle 9 and the valve shaft 25.

Figure 3A:
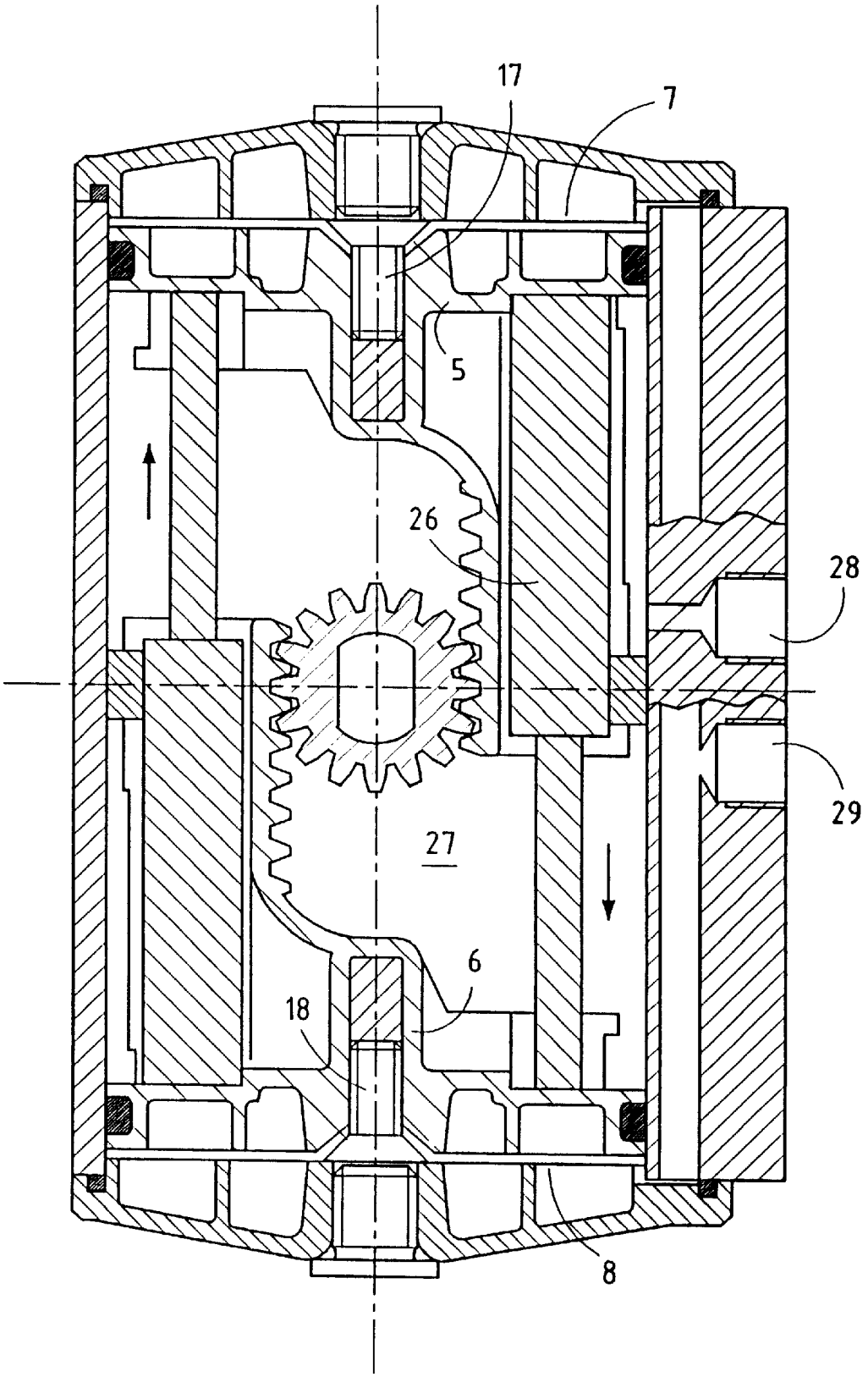
Figure 3B:
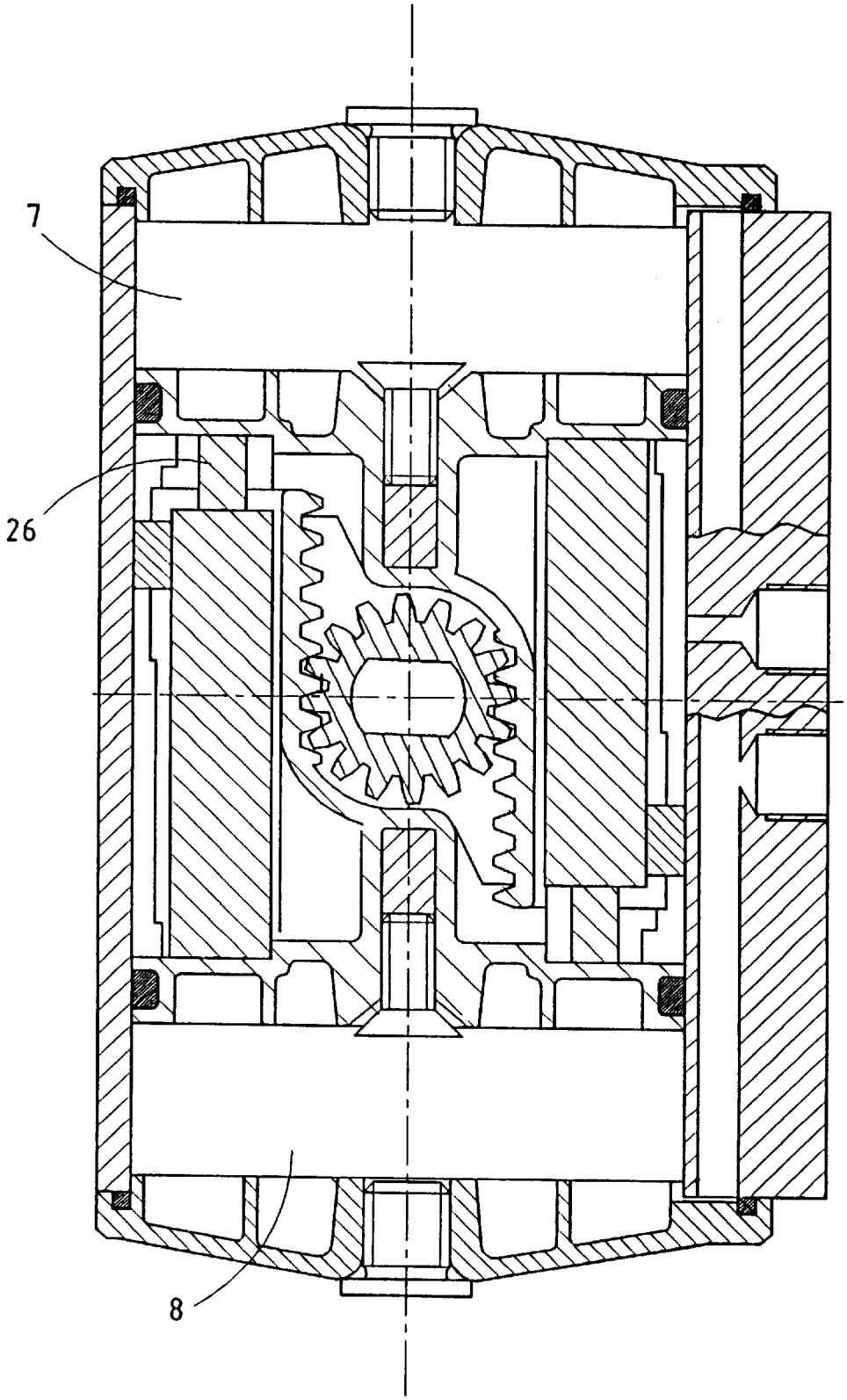

FIGS. 3*a* and 3*b* show an actuator of the type comprising a double-action jack. The same parts are shown as in the previous Figures with the exception of the spacer springs. Their function is replaced by another working chamber 27.

Elements 19 acting as shock absorbers 26 may be arranged between the pistons 5,6. The shock absorbers 26 are attached to the pistons 5,6 by known means. In order to move the pistons 5,6 apart, the pressure in the working chamber 27 is increased until it is higher than the pressure in the working chambers 7, 8. The end-of-travel position is determined by abutments 17, 18 placed in the pistons 5,6.

In order to move the pistons 5,6 apart, the pressure in the working chamber 27 is reduced by means of the aperture 28 and the pressure in the working chambers 7,8 is increased by means of the aperture 29. The position shown in FIG. 3*b* is achieved, wherein the working chambers 7,8 are enlarged and the shock absorbers 26 are lowered. The shock absorbers 26 may be hydraulic or of some other type.

In order to produce a single-action actuator, it is also possible to adopt a similar arrangement using gas springs instead of the shock absorbers 26. The chamber 27 is vented through the aperture 28.

Figure 4:
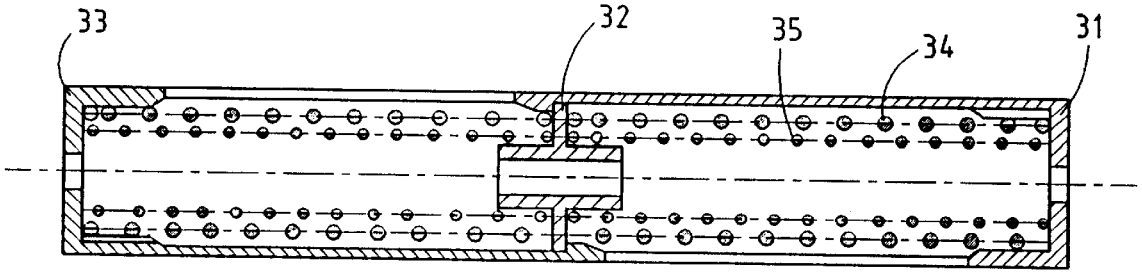
FIG. 4 shows a first spacer spring and a spacing-limiting element, in section.

FIGS. 4 to 6 show different embodiments of the spacer springs 15, 16 and the elements 19 forming a cartridge.

FIG. 4 shows an element made up of two housings 31, 33. The housings 31, 33 are attached by clipping together around a central element 32 which divides the spacer springs 34, 35 into two bundles.

Figure 5A:
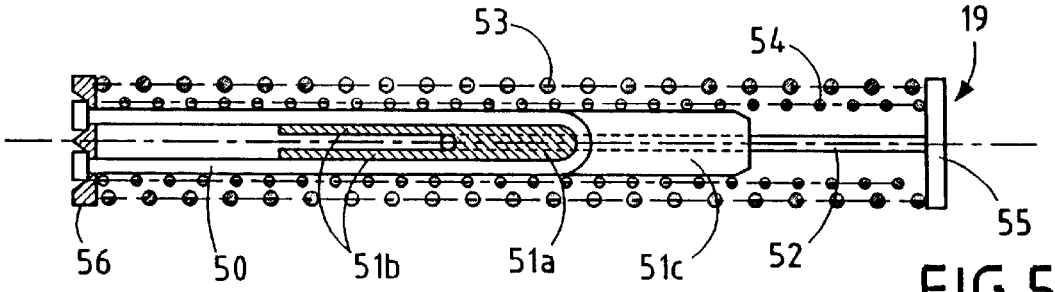
FIG. 5*a*–5*d* show a section through a second spacer spring and a spacing-limiting element and different stages of assembly.

Another embodiment of the element 19 is shown in FIGS. 5*a*–5*d*. FIG. 5*a* shows a cartridge during the cartridge loading phase. A first pin 50 is arranged with its closed end around a central structure known as the guide 51. A second pin 52 oriented in a plane perpendicular to the first is arranged in the other direction around the same guide 51 so that the two pins 50, 52 are attached by their closed end to the guide 51 and extend in opposite directions. The pins 50, 52 overlap in the central structure 51. The guide 51 has a central zone 51*a* from which extend two plates 51*b* enclosing the pin 52 and two plates 51*c*, one of which is shown, enclosing the pin 50.

Figure 5B:
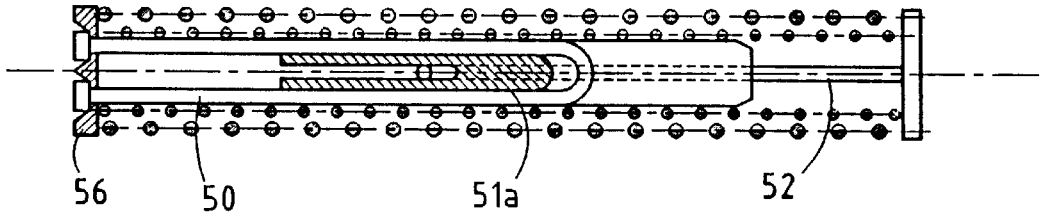
Figure 5C:
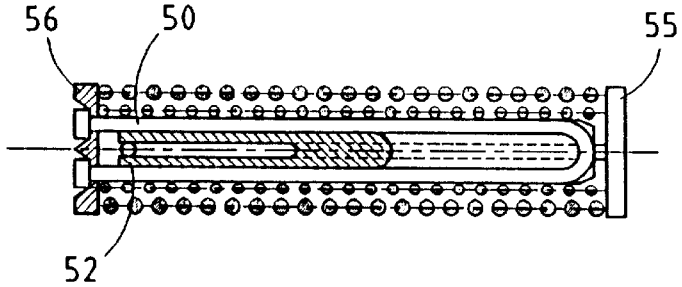
Figure 5D:
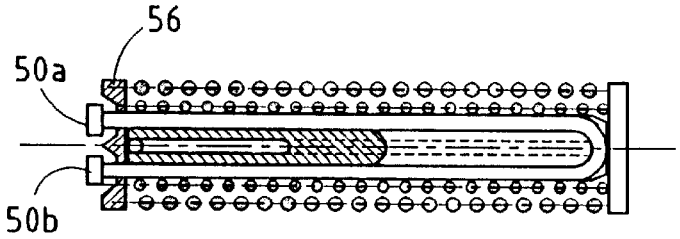

The central zone 51*a* and the plates 51*b*,51*c* guide the pins 50,52 and, at the same time, spacer springs 53,54 arranged around the element 19. The spacer springs 53,54 bear against washers 55,56 fixed to the free ends of the pins 50,52. After the pistons have been placed in the spaced apart position as shown in FIG. 5*b*, the length of the cartridge has decreased, creating prestressing, and the pins 50,52 have become detached from the central zone 51*a*. In the compressed phase in which the pistons are close together, the ends of the pins 50,52 are still not touching the washers 55,56, the coils of the springs 53,54 are not yet pressed together and there is still a short distance to make up, FIG. 5*c*.

This spacing is necessary in order to deform the open ends 50*a*, 50*b* of the pins 50,52 so as to obtain the cartridge in FIG. 5*a*. Before the deformation of the end 50*a*, the latter passes through an aperture in the washer 56. Then the end 50*a* is deformed to take the shape of the end 50*b*. The flattened end 50*b* no longer passes through the openings in the washer 56, the washer is fixed and the cartridge is complete, FIG. 5*d*.

To avoid buckling of the spacer springs, FIG. 6*a* shows an element 19 with two pins 60,62 around a central zone 61*a* of a guide 61 fitted with a collar 63. This collar 63 is placed between two bundles of spacer springs 64, 65 so that it is still guided in the recess of the projecting portions 11, 12 of the pistons 5,6. This ensures low friction which results in a high yield for the actuator. In order to increase the stability of the guide 61 the plates 61*a*, 61*b* are attached to the ends by the parts 61*d*,6*ie*.

The structure of the guide 61 will be better understood from FIGS. 6*b*–6*d*. There is the collar 63 around the central zone 61*a*. From the centre upwards in FIG. 6*b* run two plates 61*b*,61*c* enclosing a space 67. The plates 61*b*,61*c* do not cover the full width of the guide but leave shoulders 68*a*,68*b* for guiding the pin 60 in a first plane. At the end of the plates 61*b*,61*c* is the part 61*d* connecting the plates 61*b*,61*c* and closing off the space 67. In a perpendicular plane, the pin 60 is guided by the plate 69 from the centre downwards in FIG. 6*b*. Here again, there is a part 61*e* providing the connection to the second plate 70, shown in FIG. 6*c*.

FIG. 6*c* shows the symmetrical structure of the guide 61. The same parts are found as in FIG. 6*b*. FIG. 6*d* shows the collar 63 and the shoulders 68*a*,68*b* for guiding the pin 60.

Industrial Application

The actuator according to the invention is particularly well suited to driving a valve device through a quarter turn, be it a throttle-type valve or a dome-type valve.

I claim:

1. An Actuator comprising a jack with a first piston and a second piston cooperating with a control spindle, wherein energy accumulator cartridges and/or shock absorbing elements are placed between the first piston and the second piston acting at one end against the first piston and at the opposite end against the second piston.

2. An Actuator according to claim 1, wherein the energy accumulating cartridges are helical springs cooperating with a first element which limits travel, arranged inside the springs, the first element comprising a second element and a third element operating as rods and partially guided in a central structure.

3. An Actuator according to claim 2, wherein the second element and the third element operating as rods overlap in the central structure.

4. An Actuator according to claim 3, wherein the second element and the third element operating as rods are pins oriented in opposite directions and perpendicularly to one another about the central structure.

5. An Actuator according to claim 2, wherein, in order to fix washers, the ends of the second element and the third element are deformed.

6. An Actuator according to claim 2, wherein the central structure is fitted with a collar and the helical springs are divided into two bundles arranged on either side of the collar.

7. An Actuator according to claim 2, wherein the central structure comprises plates which extend towards the washers and between which the second element and the third element are guided.

8. An Actuator according to claim 1, wherein the energy accumulating cartridges are helical springs cooperating with a travel limiting element, the travel limiting element comprising two housings connected to one another so as to enclose the helical springs.

9. An Actuator according to claim 8, wherein the two housings are connected around a central element dividing the helical springs into two bundles.

10. An Actuator according to claim 2, wherein the first element also acts as a shock absorber.

* * * * *